United States Patent [19]

Peterson

[11] 4,070,962

[45] Jan. 31, 1978

[54] REFUSE COMPACTORS

[76] Inventor: Robert A. Peterson, 8756 33rd Ave., Kenosha, Wis. 53140

[21] Appl. No.: 717,675

[22] Filed: Aug. 25, 1976

[51] Int. Cl.[2] ..... B30B 7/00; B30B 15/06

[52] U.S. Cl. ..... 100/209; 100/219; 100/233; 100/245; 100/269 R; 100/295

[58] Field of Search ..... 100/233, 269 R, 219, 100/209, 295, 53, 240, 245, 90, 265; 53/24

[56] References Cited

U.S. PATENT DOCUMENTS

| | | | |
|---|---|---|---|
| 293,335 | 2/1884 | Knapp | 100/90 X |
| 1,703,783 | 2/1929 | Schmidt | 100/265 X |
| 3,254,467 | 6/1966 | Garrow et al. | 53/24 |
| 3,835,767 | 9/1974 | Peterson | 100/233 X |
| 3,835,769 | 9/1974 | Peterson | 100/295 X |
| 3,899,967 | 8/1975 | Powers | 100/269 R |

FOREIGN PATENT DOCUMENTS

| | | | |
|---|---|---|---|
| 1,327,946 | 4/1963 | France | 53/24 |

*Primary Examiner*—Billy J. Wilhite
*Attorney, Agent, or Firm*—Frederick E. Mueller

[57] ABSTRACT

A refuse compactor having a container with a refuse compression space on one side of a pressure plate which is movable by atmospheric pressure, upon evacuation of the refuse space, in one direction through a compression stroke to compress refuse in the space. The pressure plate is movable in the opposite direction through a return stroke by either pressurizing of the refuse space or evacuation of a space, which may be a second refuse compression space, at the opposite side of the plate. The refuse compactor is adapted to be emptied by a conventional trash collection vehicle equipped with a trash bin elevating and inverting mechanism, e.g., a fork lift. The plate includes a wiper for prolonging the life of the pressure plate seal and the compactor includes a novel vacuum pump and valve system for operating the pressure plate.

34 Claims, 19 Drawing Figures

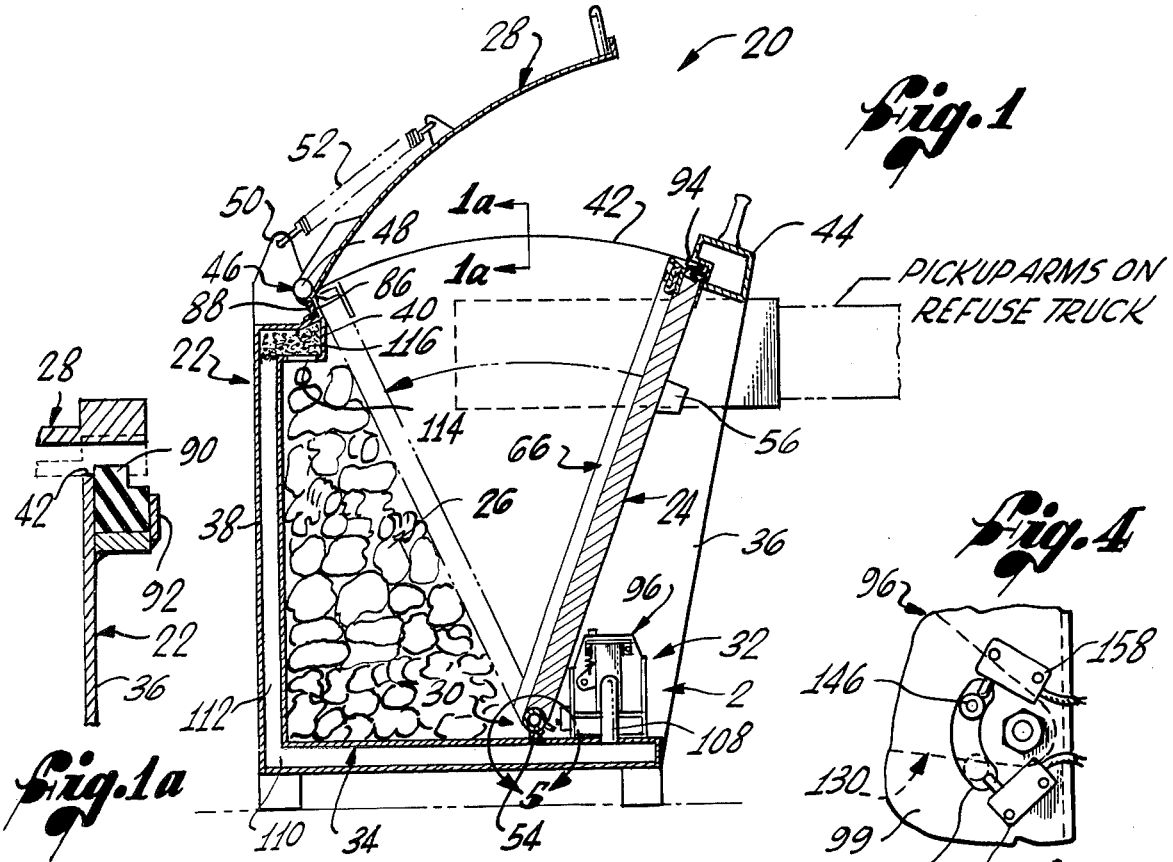
Fig. 1
Fig. 1a
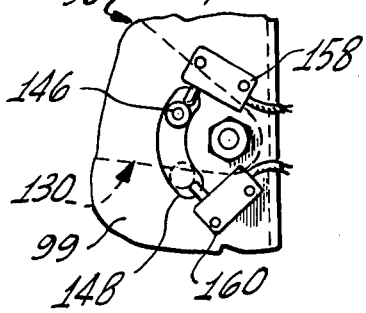
Fig. 4
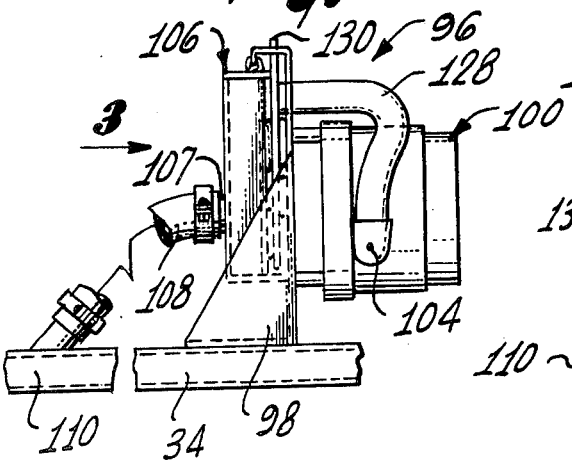
Fig. 2
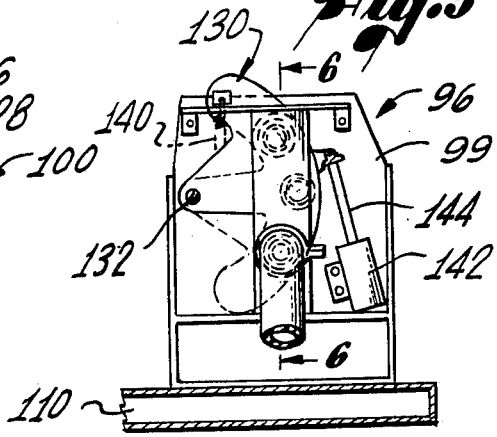
Fig. 3
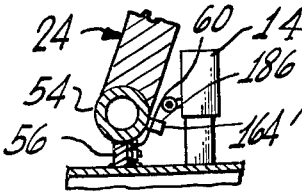
Fig. 5

REFUSE COMPACTORS

BACKGROUND OF THE INVENTION

1. Field of the Invention

This invention relates generally to refuse compactors and more particularly to an improved refuse compactor of the class described in my prior U.S. Pat. Nos. 3,835,767 and 3,835,769.

2. Prior Art

Broadly stated, my prior patents describe refuse compactors of a class having a pressure plate which is movable by ambient air pressure through a refuse compaction stroke to exert a compression force on refuse in the compactor. As noted in these patents, it was previously known to utilize super-atmospheric air, that is compressed air, for driving the compactor plate through its compression stroke. These super-atmospheric air powered compactors have certain disadvantages and inherent safety hazards which are discussed in the patents. My prior refuse compactors described in the patents avoid these safety hazards and disadvantages.

Suffice it to say here that my patented compactors overcome or avoid such hazards and disadvantages by utilizing atmospheric pressure, not super-atmospheric pressure, to drive the pressure plate through its refuse compression stroke. To this end, my patented refuse compactors have a refuse container with rigid walls and a movable pressure plate which are disposed in mutual sealing relation to form a refuse compression space at one side of the pressure plate. The pressure plate is movable in the direction of the refuse space through a compression stroke to compress refuse in the space.

Movement of the pressure plate through its compression stroke is accomplished by evacuating the refuse space to effect driving of the plate through the stroke by atmospheric pressure acting on the outer surface of the plate. The pressure plate is driven through its return stroke by spring action upon venting of the refuse space to atmosphere.

SUMMARY OF THE INVENTION

This invention provides an improved atmospheric pressure powered refuse compactor of the general class described in my prior patents.

According to one aspect of this invention, the compactor pressure plate is driven through its return stroke by low air pressure rather than the spring action of my patented refuse compactors. This air pressure return of the pressure plate remains safe and results in a simpler, less costly, and more reliable refuse compactor. To this end, the present improved refuse compactor, like my patented refuse compactors, has a refuse container with relatively rigid walls and a movable pressure plate disposed in fluid sealing relationship to certain of the walls to form a normally relatively air tight refuse compression chamber at one side of the plate. The pressure plate is driven in one direction through a refuse compaction or compression stroke, to compress refuse in the refuse space, by atmospheric pressure, resulting from evacuation of the space.

Return of the pressure plate in the opposite direction is accomplished by creating across the plate a pressure differential for driving the plate through its return stroke. In one described embodiment of the invention, this pressure differential is created by a slight pressurizing of the refuse compression space of the compactor, as mentioned. In other described embodiments, the pressure differential returning the pressure plate is created by venting the refuse space to atmosphere and evacuating a second space at the opposite side of the plate. One of these latter embodiments is a double acting refuse compactor, wherein the spaces at both sides of the pressure plate form refuse compression spaces, and the plate is movable by atmospheric pressure through a compression stroke in one direction to compress opposing refuse in one space, and through a compression stroke in the opposite direction, to compress opposing refuse in the other space.

According to an additional feature of the described embodiments, the pressure plate is arranged in such a way that gravity acts on the plate in the direction of its refuse compression stroke during a terminal portion of this stroke. As a consequence, if desired, following each operation of the compactor, the pressure plate may be left at the end of its compression stroke to exert on the refuse in the refuse compression chamber a continuous compression force for producing a permanent set in the compressed refuse. According to another feature of the invention, the compactor is adapted to be emptied by a conventional trash collection vehicle, such as front, side, or rear loaders, equipped with a trash bin elevating and inverting mechanism. The compactor also includes a novel wiper, along the edge of the pressure plate, in advance of the pressure plate seal relative to the direction of plate motion through its compression stroke, for wiping from the container surfaces broken glass or other particles which would damage the plate seal, thus to prolong the life of the seal and to prevent interference with the action of the seal by the refuse. Another feature of the invention resides in a unique dual purpose vacuum pump and valve arrangement for evacuating (or slightly pressurizing) compactor spaces to drive the pressure plate through a refuse compression stroke or a return stroke.

BRIEF DESCRIPTION OF THE DRAWINGS

FIG. 1 is a vertical fore and aft section through a refuse compactor according to the invention, showing a cover of the compactor in open position for placement of refuse into the compactor;

FIG. 1*a* is a section taken substantially on line 1*a*—1*a* of FIG. 1;

FIG. 2 is an enlarged view, looking in the direction of the arrow 2 in FIG. 1, of a combination vacuum pump and valve assembly embodied in the refuse compactor;

FIG. 3 is a view of the pump and valve assembly looking in the direction of the arrow 3 in FIG. 2;

FIG. 4 is a fragmentary rear view of the pump and valve assembly;

FIG. 5 is an enlargement of the area encircled by the arrow 5—5 of FIG. 1;

DESCRIPTION OF THE PREFERRED EMBODIMENTS

Figure 6:
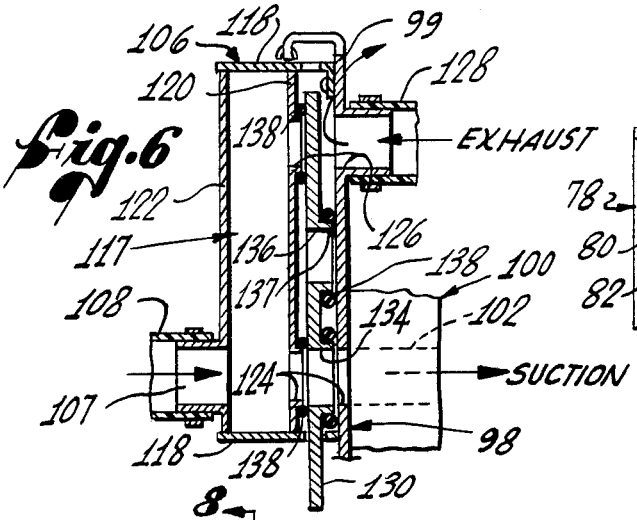
FIG. 6 is an enlarged fragmentary section through the valve and pump assembly taken on line 6—6 in FIG. 3.
Figure 8:
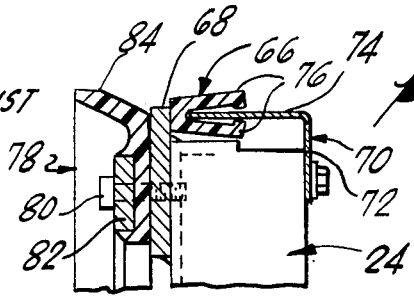
FIG. 8 is a further enlarged section taken on the line 8—8 in FIG. 7.
Figure 7:
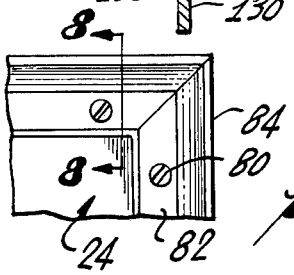
FIG. 7 is an enlarged fragmentary detail of the compactor pressure plate.

Turning initially to FIGS. 1–10, refuse compactor 20 comprises a refuse container 22 with relatively rigid walls and a movable pressure plate 24 normally disposed in fluid sealing relation to the container walls to form a normally generally air tight refuse compression chamber 26 at one side of the plate. Means 28 on the container provide access to the space 26 for placement of refuse in and dumping of compacted refuse from the space. In this instance, the access means 28 comprises a hinged cover which forms the top wall of the container 22.

Pressure plate 24 is supported, by means 30, in the container 22 for movement in the direction of the refuse compression space 26 through a compaction or compression stroke to compress refuse in this space. This compression stroke of the plate is indicated by the arrow in FIG. 1 and occurs from the solid line position of the plate to its broken line position. The pressure plate 24 is movable in the opposite direction from its broken line position to its solid line position through a return stroke.

Pressure plate operating means 32 are provided for selectively evacuating the refuse compression space 26 to produce an atmospheric pressure force on the pressure plate 24 in the direction of its compression stroke and producing a pressure differential across the plate in the opposite direction, that is, in the direction of the return stroke of the plate. Evacuation of the compression space 26 by the pressure plate operating means 32 effects movement of the pressure plate 24 through its compression stroke, from the solid line to its broken line position in FIG. 1, to compress refuse in the compression space. Operation of the means 32 to produce a pressure differential across the pressure plate 24 in the direction of its return stroke effects movement of the plate through this return stroke from its broken line position to its solid line position in FIG. 1.

More specifically, the refuse container 22 is generally rectangular in shape and has relatively rigid walls including a bottom wall 34, end walls 36, and a side wall 38 which, in this instance, is the rear container wall. As already noted, the container has a top wall 28 which forms a hinged cover for the container.

The upper edge of the rear container wall 38 is laterally enlarged to form along this edge a forwardly projecting flange 40. Flange 40 extends the full length of the rear wall between the container end walls 36. Also extending between the ends walls, along the front side of the container 22, and rigidly joined to the upper end wall edges 42, is a cross beam 44. This cross beam may be a hollow channel, as shown.

The container cover 28 is joined along its rear edge to the rear container wall 38 by a hinge 46 for swinging movement of the cover between its open and closed positions. Hinge 46 comprises a hinge shaft 48 extending along and welded to or otherwise rigidly joined and sealed to the rear edge of the cover 28. The ends of this hinge shaft extend beyond the ends of the cover and are journalled in bearings (not shown) fixed to the ends of the container. The rear edge of the cover overlies the upper rear container wall flange 40 and the ends of the cover overlie the upper end wall edges 42.

Connected between the cover 28 and upstanding brackets 50 rigidly joined to the rear container wall 38, adjacent the container ends, are tension springs 52 which yieldably bias the cover toward its open position. The tension force in these springs may be such that they either normally retain the cover open in its position of FIG. 1 to permit placement of refuse in the container without opening the cover, or they permit the cover to close and merely aid in opening the cover. In closed position, the cover seats on the upper end wall edges 42 with the front edge of the cover located immediately behind the front container cross beam 44. As described below, sealing means are provided for mutually sealing the container walls, cover, and pressure plate to one another when the cover is thus closed.

In the particular refuse compactor shown, the pressure plate supporting means 30 is a hinge connection along the bottom container wall 34 and the bottom edge of the pressure plate 24 which supports the plate for fore and aft swinging movement through its refuse compression and return strokes. Rearward swinging of the pressure plate through its compression stroke compresses refuse in the refuse space 26 which is formed between the plate and rear container wall 38. Forward swinging of the pressure plate through its return stroke re-opens the refuse space 26 upwardly for placement of refuse in and removal of refuse from the space when the cover 28 is opened.

The pressure plate hinge connection 30 comprises a hinge shaft 54 welded or otherwise joined to the bottom edge of the pressure plate 24. The ends of this hinge shaft extend beyond the ends of the pressure plate and are journaled in bearings (FIG. 15) in the container end walls 36. In its forward limiting position shown in solid lines in FIG. 1, the pressure plate 24 rests against stops 56 fixed to the inner sides of the container end walls 36. The upper edge of the pressure plate is then located adjacent (or may underlie) the front container cross beam 44. In its rear limiting position, the upper edge of the pressure plate rests against the container rear wall flange 40.

The pressure plate hinge connection 30 is located on bottom wall 34 about midway or equidistantly between the front plate stops 56 and the rear wall flange 40. Accordingly, during each of its compression and return strokes, the pressure plate swings overcenter though and beyond a vertical position, such that through a terminal portion of each stroke, gravity urges the plate toward the end of the stroke. This gravity bias of the overcenter pressure plate is utilized to retain the pressure plate in compressing contact with the refuse in the refuse space 26 at the end of its compression stroke to produce a permanent "set" in the refuse, as explained later, and retains the plate in its forward position of FIG. 1 at the end of its return stroke.

The upper edges 42 of the container end walls 36 are substantially flush with the upper edge of the pressure plate 24 and are circularly curved about the pivot axis of the plate. The container cover 28 is cylindrically curved to conform to the end wall edges 42 and about an axis which approximately coincides with the pressure plate pivot axis when the cover is closed.

As noted earlier, the pressure plate operating means 32 effects movement of the pressure plate 24 through its refuse compression stroke by evacuating the refuse space 26 and through its return stroke by producing a pressure differential across the plate. In the particular refuse compactor illustrated, this pressure differential across the pressure plate is created by pressurizing the refuse space 26. This pneumatic operation of the plate through its compression and return stroke requires sealing of the refuse space 26 to make it substantially air tight. The sealing means for this purpose will now be described.

Figure 9:
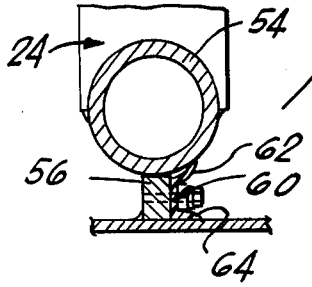
FIG. 9 is an enlarged fragmentary section detailing the pressure plate hinge seal.
Figure 10:
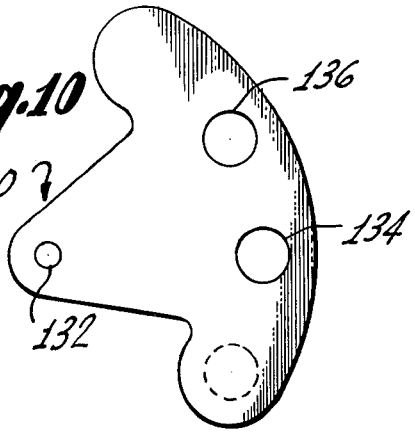
FIGS. 10 and 10*a* are schematic views of different positions of the vacuum pump valve means relative to the pump inlet and oulet.
Figure 10A:
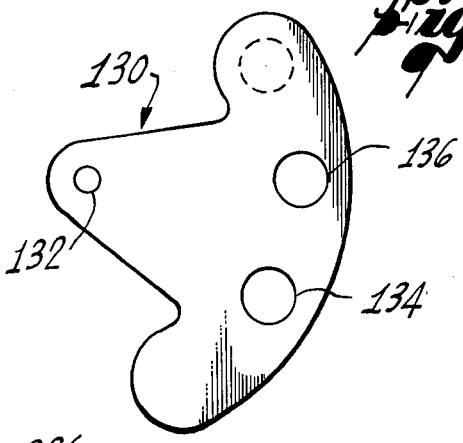

Rising from the bottom container wall along the underside of the pressure plate hinge shaft 54 is a rib 56 (FIGS. 5, 9). Attached to the outer or front side of this rib is a sealing strip 60 having flexible sealing lips 62, 64, which bear against the shaft 54 and the bottom container walls 34, respectively. When the refuse space 26 is evacuated, atmospheric pressure acting on the outer sides of these lips urges the latter into sealing contact with the shaft and the bottom wall. Seals (not shown) are also provided for the ends of the hinge shaft 54 which, as noted earlier, are journaled in bearings externally on the container end walls 36.

Extending along the vertical end and horizontal top edges of the pressure plate 24 is a flexible sealing strip 66 (FIG. 8) of generally V-cross-section having a relatively flat apexed edge. This flat apexed edge points rearwardly or endwardly toward and seats against a flange bar 68 secured to the inner or rear side of the pressure plate 24 along its end and top edges. Also extending along the end and top edges of the pressure plate 24 is a seal retainer channel 70 of L-cross-section having a front flange 72 and an edge flange 74. The front flange 72 seats against and is secured to the outer or front side of the pressure plate. The edge flange 74 extends inwardly and rearwardly across the end and top edges of the pressure plate and between the legs 76 of the sealing strip 66 to hold the flat apexed edge of the sealing strip against the flange bar 68.

The outer flexible leg 76 of the sealing strip 66 bears against the container end walls 36 and cover 28 when the latter is closed. When the refuse space 26 is evacuated to drive the pressure plate 24 through its rearward refuse compression stroke, atmospheric pressure acting on the inner or underside of the leg urges the latter outwardly into firm sealing contact with the end walls and cover and urges the inner leg 76 into tight sealing engagement with edges of the plate 24.

In use of the present refuse compactor, broken glass or other sharp objects may adhere to the inner sealing surfaces of the container end walls 36 and cover 28 and thereby tend to cut or otherwise degrade or interfere with sealing action of the outer leg 76 of the pressure plate seal 66. To alleviate this problem, the pressure plate 24 is provided with a wiper 78. This wiper travels ahead of the pressure plate seal 66 during the rearward refuse compression stroke of the pressure plate 24 and scrapes or wipes any debris from the inner end wall and cover surfaces. Wiper 78 comprises a flexible strip (FIG. 7, 8) similar to a sealing strip but of more durable material and/or construction. This wiper is fastened to the inner or front side of the pressure plate 24 by screws 80 which pass through a reinforcing bar 82 embedded in the strip. The wiper strip has a resiliently flexible wiping lip 84 which is normally biased beyond the end and top edges of the pressure plate 24 into wiping contact with the container cover 28 and end walls 36 during the rearward refuse compression stroke of the plate.

The rear edge of the cover 28 is sealed to the rear container wall flange 40 in essentially the same way as the lower pressure plate edge is sealed to the bottom container wall 34. Thus, the walls of the flange 40 are turned upwardly and rearwardly and joined face to face, as shown, to form an upstanding rib 86 along the underside of the cover hinge shaft 48. Secured to the outer or rear side of this rib is a sealing strip 88 like the pressure plate seal strip 60 (FIG. 9). Sealing strip 88 has a flexible sealing lip seating against the shaft 48. When the refuse space 26 is evacuated to drive the pressure plate 24 rearwardly through its refuse compression stroke, atmospheric pressure acting on the outer side of this sealing lip urges the latter into sealing contact with the shaft 48. The ends of the cover hinge shaft 48 are also sealed by sealing means (not shown).

As best shown in FIG. 1, the ends of the container cover 28, when closed, are sealed to the container end walls 36 by downward seating of the cover ends against yieldable seals 90 along the upper end wall edges 42. These cover seals 90 are contained within channels 92 fixed to the outer sides of the end walls. Seals 90 and their containing channels 92 are curved to conform to the end wall edges 42. The seals project above the edges, as shown in FIG. 1, for compressible sealing contact with the cover when closed. Seals 90 extend the full length of the end wall edges 42 from the rear wall flange to the front container cross beam 44.

Fixed within a recess along the lower rear edge of the cross beam 44 is a sealing strip 94. This sealing strip has a flexible sealing lip which engages the front edge of the cover 28 when closed to seal this cover edge to the beam. When the pressure plate 24 occupies its forward limiting position shown in solid lines in FIG. 1, the upper pressure plate seal 66 engages either the cross beam 44 or the cover 28.

From the description to this point, it will be understood that when the cover 28 is closed, the refuse space 26 is sufficiently sealed to permit pneumatic operation of the pressure plate 24 through its compression and return strokes by the pressure plate operating means 32. In view of the large area of the plate 24 appreciable leakage at some points of the various seals can be tolerated and a sufficient pressure differential achieved to move the plate 24 in both directions.

Pressure plate operating means 32 comprises a combination vacuum pump and valve unit 96 mounted on the bottom container wall 34, just forwardly of the lower edge of the pressure plate 24. The unit has a mounting bracket 98 attached to the bottom wall 34 and having an upright mounting plate 99 on one side of which is mounted a vacuum air pump 100. Vacuum pump 100 has a suction opening or intake 102 (FIG. 6) and an outlet or discharge 104 (FIG. 2).

Mounted on the opposite side of the mounting bracket plate 99 from the vacuum pump 100 is a control valve 106. Valve 106 has a port 107 connected by a conduit 108 to an air passage 110 in the bottom container wall 34. Passage 110 communicates with an air passage 112 in the rear container wall 38. These passages may be provided in any convenient way, as by tubing. The rear container wall passage 112 opens to the refuse space 26 through the hollow interior of the upper rear wall flange 40 and an opening or a row of openings 114 (FIG. 1) in the underside of the front projecting portion of the flange. Filter material 116 is contained in the flange 40, as shown, to filter passing air, particularly passing air drawn from the refuse space 26 as described later.

Valve 106 is operable to selectively communicate the vacuum pump intake 102 or discharge 104 to the refuse space 26 through the port 107, conduit 108, and the container wall passages 110, 112. To this end, the valve comprises a relatively narrow vertically elongated plenum 117 at the side of the mounting bracket plate 99 opposite the vacuum pump 100. Plenum 117 is attached to the bracket plate 99, in spaced relation thereto, by the upper and lower plenum end walls 118, which extend beyond the plenum to the bracket plate, as shown. Plenum 117 has an inner wall 120 adjacent the bracket plate 99 and an opposite outer wall 122 containing the port 107.

Bracket plate 99 and the inner plenum wall 120 have aligned ports 124, 126. Bracket plate port 124 registers with the vacuum pump intake 102. Bracket plate port 126 communicates through a hose 128 to the vacuum pump discharge 104.

Between the bracket plate 99 and the inner plenum wall 120 is a generally sector shaped valve shuttle plate 130. This valve plate is pivoted at 132 on the bracket plate 99 for oscillation between its solid line positions of FIGS. 3 and 6. For reasons which will appear presently, the valve plate position of FIG. 6 is referred to as its pack position and the solid line valve plate position of FIG. 3 is referred to as its retract position. Valve plate 130 has two openings 134 and 136 of substantially the same size as the valve ports 124, 126, as may be best observed in FIG. 6.

Formed on the outer or right hand side of the plenum wall 120 and the right hand side of the shuttle valve plate 130, in FIG. 6, about the wall and valve plate openings 124, 126, 134, 136, are annular shoulders 137. Surrounding and secured to the shoulders are O-rings 138. The O-rings on the plenum wall 120 seat slidably against the adjacent side of the valve shuttle plate 130 to provide air tight seals between the plenum wall and valve plate. The O-rings on the valve plate seat slidably against the mounting bracket plate 99 to provide air tight seals between the valve plate and bracket plate.

In the lower pack position of the valve plate 130 in FIG. 6, the lower valve plate opening 134 registers with and communicates the valve vacuum pump intake ports 124. The upper end of the valve plate 130 then closes the upper valve plenum port 126 but uncovers the upper bracket plate vacuum pump discharge port 126 to communicate the latter to atmosphere through the open sides of the space between the bracket plate 99 and the plenum 106. In the upper retract position of the valve shuttle plate 130 in FIG. 3, the upper valve plate port 136 registers with and communicates the valve vacuum pump discharge ports 126. The lower end of the valve plate 130 then closes the lower plenum port 124 but uncovers the lower bracket plate vacuum pump intake port 124 to communicate the latter to atmosphere through the open space between the bracket plate and the plenum.

It will now be understood that in the lower pack position of the valve shuttle plate 130 in FIG. 6, the vacuum pump discharge 104 opens to atmosphere and its intake 102 communicates to the refuse space 26 through the lower valve ports 124 and valve plate opening 134, the plenum 106, conduit 108 and container wall passages 110, 112. Operation of the vacuum pump 100 in this valve position with the container cover closed evacuates the refuse space 26 to effect movement of the pressure plate 24 through its rearward refuse compression stroke by atmospheric pressure to "pack", i.e., compress, the refuse in the space. In the upper retract position of the valve plate 130 in FIG. 3, the vacuum pump intake 102 opens to atmosphere and its discharge 104 communicates to refuse space 26 through the upper valve ports 126 and valve plate opening 137, plenum 106, conduit 108, and container wall passages 110, 112. Operation of the vacuum pump 100 in this valve position pressurizes the refuse space 26 sufficiently to drive the pressure plate 24 forwardly, i.e., retract the plate, through its return stroke. During retraction, the wiper 84 is an effective seal but the plate hinge seal 60 and cover hinge seal 88, depending on their cross-sectional thickness, may leak at some points. Nevertheless, sufficient pressure can be built up in the space 26 to return the plate 24 which is opposed only by its weight and plate edge seal friction.

Figure 15:
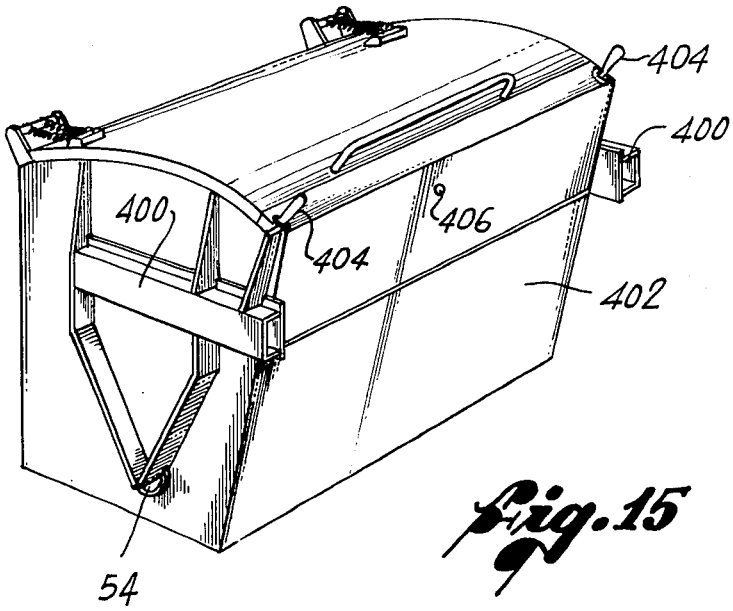
FIG. 15 is a perspective view of a refuse compactor according to the invention illustrating the construction of the compactor, whereby the latter may be emptied with a fork lift mechanism of a conventional trash collection vehicle.

As is schematically shown in FIG. 15, the framework of the container may be provided with a pair of toggle locks 404 along the top front edge to releasably hold the cover in closed position. These may be entirely manual in operation or, alternatively, the front cover panel 402 of the container may be fitted with a key control switch 406 comprising part of a control circuit such that, when the key is inserted and turned in one direction, solenoids associated with the toggle locks 404 are energized to permit release of the cover, which is preferably sufficiently spring counter-balanced to open itself upon energization of the solenoids.

Referring to FIG. 1, assuming the container to be empty, the pressure plate 24 will normally occupy the retracted solid line position indicated. Refuse can then be dumped under the open cover 28 to fall to the floor of the container.

Preferably, the cover 28 is closed and locked, and the pressure plate 24 run through a cycle of extension and retraction on successive partial loads rather than accumulating a full load to the level of the upper edge of the pressure plate before the first actuation. In this connection, it should be noted that the mechanical advantage of the pressure plate 24 is greater in its hinge area. Accordingly, if the container is first filled to a height of, for example, one fourth the height of the pressure plate 24 and the pressure plate then run through a cycle of extension and retraction, a packing ratio of on the order of about 6 to 1 can be attained in densifying the refuse closely adjacent the hinge 30. In addition, or alternatively, if the pressure plate 24 is allowed to rest in the fully extended position, or substantially so, between additional charges of refuse, the previously mentioned gravitational bias of the overcenter pressure plate tends to impart a permanent set to the successive charges.

Referring to FIG. 3, the valve shuttle plate 130 may be normally retained in its upper retract position indicated in solid outline by means of a spring 140. On the same side of the bracket as the spring a solenoid 142 may be mounted on the bracket plate having a plunger 144 connected to the valve plate 130 for retracting it to the pack position against the action of the spring 140 when the solenoid is energized.

The radial arm of the sector-shaped valve shuttle plate 130 has a switch actuating stud 146 on one side (FIG. 4) extending through an arcuate slot 148 formed in the bracket wall 99. On the opposite side of the bracket wall 99 from the valve shuttle plate 130 a pair of micro-switches 158 and 160 are secured with their respective switch buttons positioned to be actuated by the switch stud 146 as the latter is moved between opposite ends of the slot 148 in response to reciprocal movement of the valve shuttle plate 130 in response to either the spring 140 or energization of the solenoid 142.

The control circuit may be such that, assuming the pressure plate 24 to be in the fully retracted position, the solenoid 142 is de-energized with the valve shuttle 130 then being in the raised position under the force of the spring 140. Then, upon a key switch being turned in one direction, the solenoid 142 is energized to draw the valve shuttle down to the so-called pack position and to energize vacuum pump 100 as a result of actuation of the lower micro-switch 160. The pressure plate 24 is then caused to advance, packing refuse against the rear wall of the container. The circuit may be such that the pump shuts down either by mechanical contact of the pressure plate 24 or with a suitably located switch or by a timer in the circuit timing out. In either event the pressure plate would then lay against the refuse until the time of the next deposit of refuse. A suitable mechanical switch arrangement is shown in FIG. 5 consisting of a micro-switch 149 mounted adjacent the hinge of the pressure plate 24 with a control button in interfering alignment with an arm 164 carried by the hinge 54 to depress the switch button when plate 24 is in the fully extended position.

Assuming the pressure plate 24 to be in the fully extended position at rest and the control circuit to be open, the spring 140 returns the valve shuttle plate 130 to the raised position, in readiness to pressurize the space 26. At the same time, the switch stud 146 has been returned to the upper position of FIG. 4 in contact with the switch button of the switch 158. Then the key switch may be turned in another direction to close the control circuit through the switch 158 without energization of the solenoid 142 whereby ambient air is drawn by the vacuum pump 100 into the space 26 by virtue of the valve shuttle plate 130 remaining in the raised position.

A control circuit for the refuse compactor 20 which will control the sequential operations described above is illustrated in FIG. 16. Basically, the control circuit is of conventional design in which the operation of motors and solenoids is sequentially controlled by means of switch operated relays. In the particular illustrated control circuit, the sequence of operations is manually controlled by the operation of a momentary contact key switch 406 to unlock or open cover 28, initiate the pack cycle, and then initiate the retract cycle.

Figure 16:
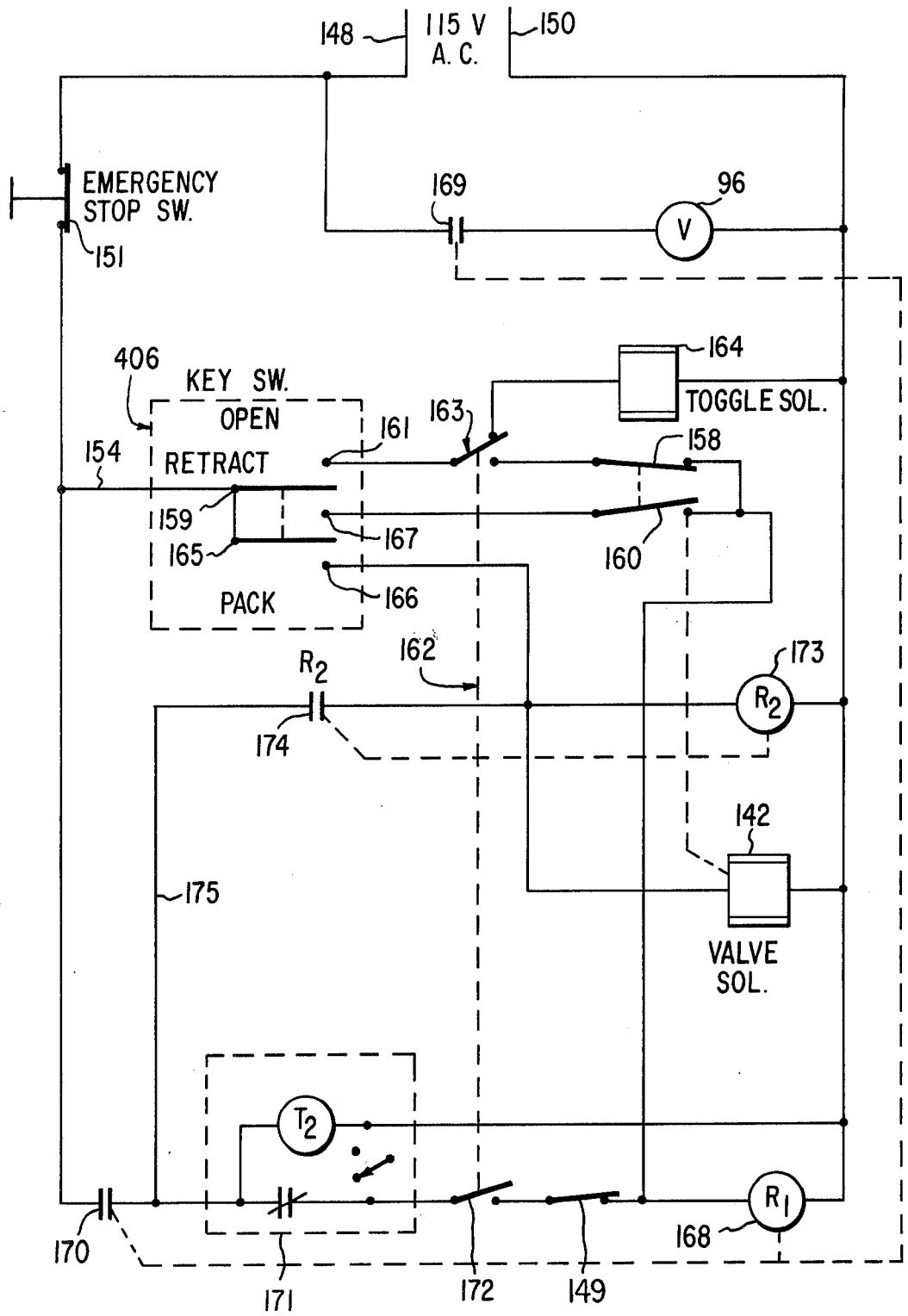
FIG. 16 is an electrical circuit diagram of the key switch and control circuit for the embodiment of FIGS. 1–10*a*.

The compactor 20 is conventionally powered by utility power lines 148, 150 with the power side being connected through a conventional emergency-stop switch 151 and a common return line 150. As noted above, the key switch 406 is a momentary contact type which is essentially a double pole-double throw with a center return. Both pole terminals are connected to the power side of the line 148 through a line 154 and, as illustrated in FIG. 16, turning the switch in an upward direction, or to the left on the actual compactor 20, provides both the cover-open function and the retract function. The switch to the right provides the pack function. It should be appreciated that, due to bootstrap relay action, the switch 406 need only be turned in either direction momentarily in order to initiate the desired operation.

Thus, when the switch 406 is initially turned to the left to provide the open function, a first pole terminal 159 of the key switch 406 is connected to a first contact 161 which provides power through a first switch section 163 of a retract-limit switch 162 to a toggle-lock-solenoid 164 which retracts the locking mechanism for the cover 28, permitting its opening. When the cover 28 is opened, the switch 406 may then be returned to its center or neutral position. When the compactor 20 is loaded, the cover is closed and the locking mechanism is automatically engaged preventing its further opening.

When the switch 406 is momentarily (4-5 seconds) turned to the right to initiate the pack cycle, a second pole terminal 165 of the switch is connected to a contact 166 which applies power to the valve solenoid 142 which, as described above, connects the vacuum pump and valve unit 96 to exhaust the air in the refuse chamber 26. As was described above, the movement of the valve solenoid 142 operates on a pair of micro-switches 158 and 160 as illustrated in FIG. 4 which opens micro-switch 158 and closes micro-switch 160. For the control circuit illustrated in FIG. 16, this permits the application of power from pole terminal 159 through a contact 167 and further through micro-switch 160 to energize a first relay 168.

As illustrated in FIG. 16, energizing relay 168 closes a pair of contactors 169 and 170, with contactor 169 connecting the power on line 148 to the vacuum pump and valve unit 96 which causes the refuse chamber 26 to be exhausted and causing the pressure plate 24 to move towards its second position. Closing of the contactor 170 also initiates the operation of the timer 171. As the pressure plate 24 moves away from its retracted position, the retract-limit switch 162. section 163 and a second retract-limit switch section 172 are closed which not only maintains the compactor 20 in the pack cycle, but also sets up the control circuitry for the retract cycle as will be described below.

It should be appreciated that once the valve solenoid 142 has caused the opening of micro-switch 158 and the closing of micro-switch 160 which energizes the first relay 168, the key switch 406 may be returned to its neutral or off position. This is because the first relay 168 is in a bootstrap circuit which is completed through contactor 170 and the closing of the second switch section 172 of the retract-limit switch 162. In addition, when the key switch 406 is turned to the pack position, power is also applied to a second relay 173 which closes its contactor 174 which then receives power through a line 175 to both maintain the valve solenoid 142 in an energized condition and also maintain the second relay in an energized condition due to bootstrap action.

As the pressure plate 24 approaches its second position, which will operate the pack limit switch 162, or the timer 171 times out, whichever occurs first, the circuit energizing the first relay 168 will open and contactors 170 and 169 will consequently open and the vacuum pump and valve unit 96 will be turned off. In addition, the removal of power from lines 175 de-energizes the second relay 173 which consequently opens its own contactor 174, removing the energizing power from the valve solenoid 142 permitting it to return to its original position and preparing the vacuum pump and valve unit 96 for the retract function.

At this point, it should be appreciated that the retract-limit switch sections 163 and 172 remain in their closed condition while the valve micro-switches 158 and 160 return to their original positions. Thus, when the retract function is selected by turning the key switch to the left, power is applied from the pole terminal 159 through contact 161 and the first section 163 of the retract-limit switch 162 through the micro-switch 158 to the first relay 168 which, again, turns on the vacuum pump and valve unit 96. It should also be appreciated that no power is applied to the valve solenoid 142 or the second relay 173. Thus, while the vacuum pump is turned on, air is pumped into the refuse chamber 26 rather than evacuated from it. Thus, the pressure plate 24 will be removed towards its retract position and, upon engaging the retract-limit switch 162, will open sections 163, 172 removing the power to the first relay 168 and subsequently turning off the motor 100. The control circuit is then returned to its initial condition and the cover 28 may be opened by turning the switch 406 momentarily to the left to unlock the locking mechanism as described above.

Figure 11A:
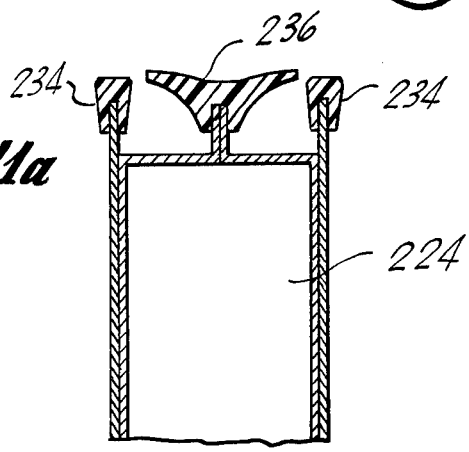
FIG. 11*a* is an enlarged section of the pressure plate seal of the modified compactor.
Figure 11:
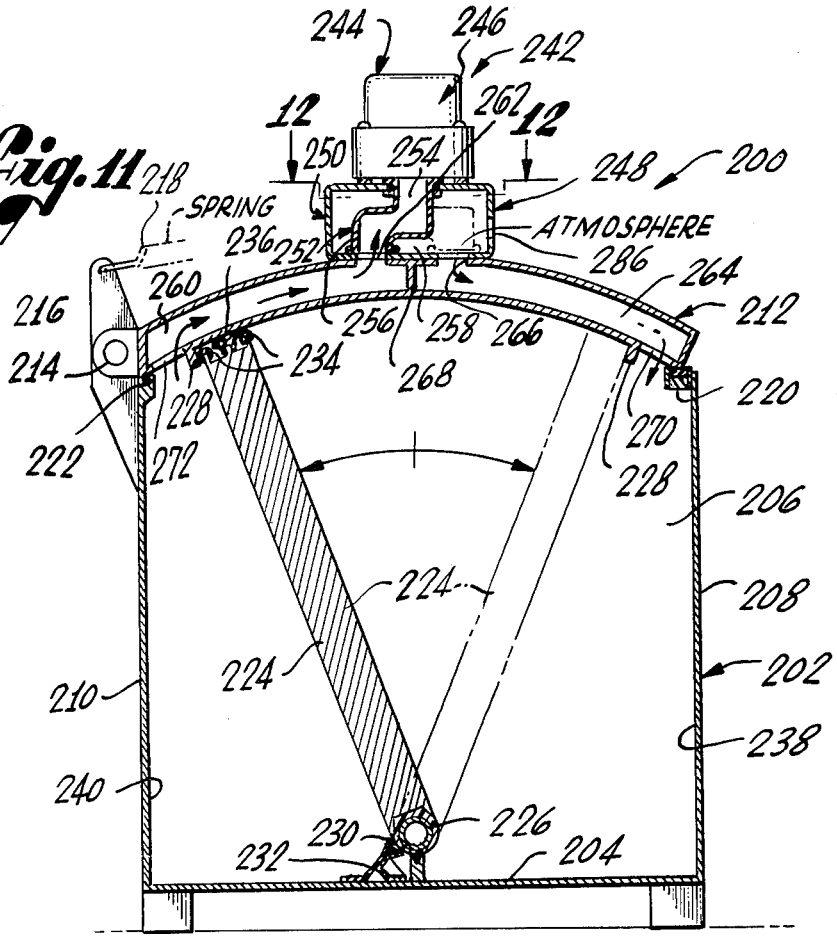
FIG. 11 is a vertical fore and aft section through a modified refuse compactor according to the invention.
Figure 12:
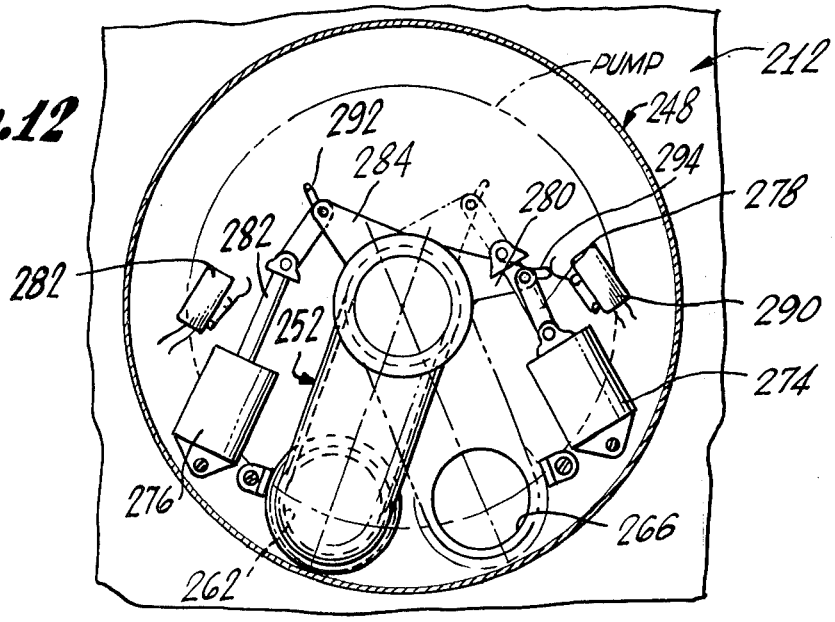
FIG. 12 is an enlarged section taken on line 12—12 in FIG. 11.

Turning now to FIGS. 11 and 12, there is illustrated a modified refuse compactor 200 according to the invention. Refuse compactor 200 has a refuse container 202 with a bottom wall 204, end walls 206, front and rear side walls 208, 210, and a cover 212. Cover 212 is attached along its rear edge to the upper edge of the rear container wall 210 by a hinge 214 for swinging movement of the cover between its open and closed positions. Connected between the cover 212 and brackets 216 rigidly attached to the rear container wall 210 is a spring 218 for biasing the cover toward its open position. In its closed position, the cover 212 is sealed about its entire perimeter to the upper edges of the container end walls 206 and side walls 208, 210 by an appropriate sealing means. In the drawings, the cover sealing means comprise seals 220, 222 along the upper edges of the container front and rear side walls 208, 210 and additional seals (not shown) along the upper edges of the container end walls 206 on which the cover seats when closed.

Within the container 202 is a pressure plate 224 which extends lengthwise of the container between its end walls 206. The bottom edge of the pressure plate is attached to side walls 206 midway between its front and rear edges, by a hinge means 226 for fore and aft swinging movement of the pressure plate between its front and rear limiting positions illustrated in broken and solid lines in FIG. 11. The upper edges of the container end walls 206 and the container cover 212 are cylindrically curved about the pivot axis of the pressure plate 224, as shown. Projecting from the underside of the cover 212 adjacent its front and rear edges are limit stops 228 against which the upper edge of the pressure plate abuts in its front and rear limiting positions.

The pressure plate 224 is sealed about its edges to the container bottom and end walls 204, 206, and cover 212. The bottom edge seal of the pressure plate comprises a sealing strip 230 engaging the lower rounded edge of the pressure plate, as shown, and mounted in a bracket 232 fixed to the bottom container wall 204. Seal 230 and its bracket 232 extend the full length of the pressure plate 224 and container 202 between the container end walls 206. Extending along the remaining end and upper edges of the pressure plate 224 are two resilient wipers 234 and a seal 236. The wipers 234 are located along the front and rear edges of the pressure plate 224 and fit over projecting ribs about the edge of the pressure plate, as shown. The seal 236 is located between the two wipers 234 and also fits over a projecting rib about the edge of the pressure plate. As may be observed in FIG. 11, this seal has laterally projecting flexible lips which engage the under surface of the cover 224 as well as the container end walls 206 to seal the pressure plate to these walls and cover. The wipers 234 wipe the sealing surfaces of the end walls and cover clean of any broken glass or other objects which would damage or obstruct action of the seal.

Refuse compactor 200 has sealed spaces 238, 240 at the front and rear sides of the pressure plate 224, both of which comprise a refuse compression space.

Embodied in the refuse compactor 200 are pressure plate operating means 242 for selectively evacuating the refuse spaces 238, 240 to effect swinging of the pressure plate 224 by atmospheric pressure through its fore and aft refuse compression strokes. Operating means 242 comprises a pressure plate operating unit 244 mounted on top of the container cover 212. This operating unit includes an upper vacuum pump 246 and a lower valve 248. The lower valve 248 has a vented cylindrical housing 250 attached along its lower edge to the cover 212. The lower end of the vacuum pump 246 is attached to the upper wall of the valve housing 250.

Within the valve housing 250 is a generally S-shaped spout-like duct 252 having parallel, laterally displaced and normally vertically disposed upper and lower ends 254, 256. The upper duct end 254 is concentric with the valve housing 250 and extends rotatably through the upper wall of the housing in communication with the intake (not shown) of the vacuum pump 246. Suitable sealing means are provided for sealing the upper duct end 254 to the upper wall of the valve housing 250 and to the vacuum pump 246. The lower end 256 of the valve duct 252 bears slidably against the bottom wall 258 of the valve housing 250. Sealing means are provided for sealing this lower duct end to the valve housing wall 258.

Valve duct 252 is rotatable between its solid and broken line positions of FIGS. 11 and 12. In its solid line position, the lower end 256 of the duct opens to a rear passage 260 in the cover 212 through a port 262 in the cover and the lower valve housing wall 258. In the broken line position of the valve duct 252, the lower duct end 256 opens to a forward passage 264 in the cover 212 through a port 266 in the cover and the lower valve housing wall 258. In the particular embodiment shown, the cover 212 has a double wall construction with an internal partition 268 which provides the separate cover passages 260, 264.

The front cover passage 264 opens to the front refuse space 238 through a port 270 in the underside of the cover 212, forwardly of the front pressure plate limit stop 228. The rear cover passage 260 opens to the rear refuse space 240 through a port 272 in the underside of the cover rearwardly of the rear pressure plate limit stop 228.

Mounted within the valve housing 250 are two solenoids 274, 276 for operating the valve duct 252 between its broken and solid line positions. Solenoid 274 has a plunger 278 connected to a radial arm 280 on the duct for rotating the duct to its solid line position when the solenoid 274 is energized. Solenoid 276 has a plunger 282 connected to a radial arm 284 on the duct 252 for rotating the latter to its broken line position when the solenoid 276 is energized. Solenoids 274, 276 and the vacuum pump 246 as well as a lock for the container cover 212 are connected in a controlled circuit (not shown) similar to that described earlier in connection with FIG. 10 for controlling the operation of the refuse compactor 200, and including a pair of micro-switches 286, 290 in operative alignment with switch actuators 292, 294 carried by the radial arms 280, 284 of duct 252. These switches are analogous to the pair shown in FIG. 4. In the wall of the valve housing 250 is a port 286 which communicates the interior of the housing to atmosphere.

It will now be understood that operation of the vacuum pump 246 with the valve duct 252 in the solid line position evacuates the rear refuse space 240 through the valve port 262, the cover passage 260, and the cover port 272 while venting the front refuse space 238 to atmosphere through the cover port 270, cover passage 264, and the valve port 266, 286. Accordingly, atmospheric pressure drives the pressure plate 224 rearwardly through a refuse compression stroke to compress refuse in the space 240. Operation of the vacuum pump 246 with the valve duct 252 in its broken line position evacuates the front refuse space 238 through the valve port 266, cover passage 264, and cover port 270 while venting the rear refuse space 240 to atmosphere through the cover port 272, cover passage 260 and valve ports 262, 286. Atmospheric pressure then drives the pressure plate 224 forwardly through a refuse compression stroke to compress refuse in the front refuse space 238. The pressure plate may be at rest in either fore or aft overcenter positions.

Figure 13:
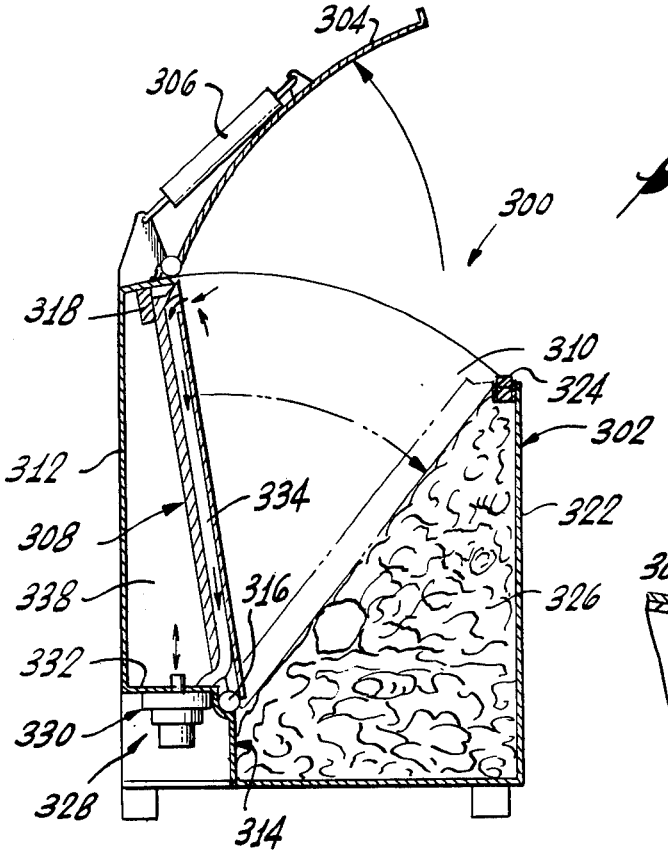
FIG. 13 is a vertical fore and aft section through a further modified refuse compactor according to the invention.
Figure 14:
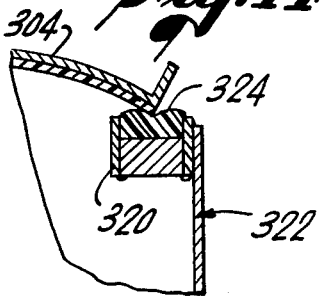
FIG. 14 is a detail of a cover seal embodied in the compactor of FIG. 13.

The modified refuse compactor 300 of FIGS. 13 and 14 uses a pressure plate operating unit substantially like that in the refuse compactor of FIGS. 11 and 12 to effect atmospheric pressure movement of the compactor pressure plate back and forth by selectively evacuating sealed spaces at opposite sides of the pressure plate. The refuse compactor 300, however, has only a single refuse space.

The refuse compactor 300 has a refuse container 302 with a hinged cover 304. As before, this cover is biased to open position by springs 306.

Within the container 302 is a pressure plate 308 which, as before, extends endwise of the container between its end walls 310. Pressure plate 308 is offset rearwardly of the fore and aft center line of the container, as shown. The rear container wall 312 has a lower, forwardly projecting step portion 314 extending the full length of the container between the container end walls 310. The lower edge of the pressure plate 308 is attached to the upper front corner of this step by a hinge 316 for fore and aft swinging movement of the plate between its rear solid line position and front broken line position in FIG. 13. In its rear solid line position, the upper edge of the pressure plate rests against a stop 318 at the rear of the container 302. In its forward limiting position, the upper edge of the pressure plate rests against a front cover seal channel 320 on the front container wall 322. The container cover 304 and the upper edges of the container end walls 310 are cylindrically curved about the pivot axis of the pressure plate 308, as shown.

Contained within the front seal channel 320 is a sealing strip 324 for sealing the front edge of the cover 304 to the front container wall 322 when the cover is closed. Additional sealing means (not shown), which may be similar to those embodied in the refuse compactor of FIGS. 1–10, are provided for sealing the remaining edges of the cover 304 and the edges of the pressure plate 308 when the cover is closed.

Refuse compactor 300 has a single refuse compression space 326 at the front side of the pressure plate 308. The pressure plate is movable forwardly, from its solid line position to its broken line position, through a refuse compression stroke to compress refuse in the space 326 and in the opposite direction from its broken line position to its solid line position through a return stroke. Pressure plate operating means 328 are provided for effecting movement of the pressure plate through these strokes.

Operating means 328 comprises a pressure plate operating vacuum pump and valve unit 330 identical to the pressure plate operating unit 244 in FIGS. 11 and 12. Operating unit 330 is mounted on the underside of the horizontal wall of the rear container wall step 314. One valve port of the operating unit 330 (corresponding to one of the ports 262, 266 of the pressure plate operating unit 244 in FIGS. 11 and 12) communicates to the refuse space 326 through a flexible hose 334 which extends edgewise through the pressure plate 308 and opens through the front side of the plate into the refuse chamber 326 adjacent the upper edge of the plate, as shown. The other valve port of the operating unit 330 opens to the space 338 at the rear of the pressure plate 308.

It will now be understood that the rotatably adjustable valve duct (not shown) of the pressure plate operating unit 330 may be positioned to selectively evacuate either of the compactor spaces 326, 338 and vent the other space to atmosphere. Evacuation of the space 338 effects rearward movement of the pressure plate 308 by atmospheric pressure to its rear retracted position of FIG. 13 to permit placement of refuse in and removal of refuse from the refuse space 326 when the cover 304 is open. Evacuation of the refuse space 326 by the operating unit 330 effects forward movement of the pressure plate 308 through its refuse compression stroke by atmospheric pressure to compress the refuse in the space.

In each of the described embodiments of FIGS. 11 to 14, the pressure plate, at the end of a refuse compressing operation, may be left in contact with the refuse in the refuse space to produce a permanent set in the refuse, as described earlier in connection with the refuse compactor of FIGS. 1 through 10.

As noted earlier, a feature of the invention resides in the fact that the refuse compactors of the invention may be emptied by a conventional refuse collection vehicle having trash bin elevating and inverting fork arms. To this end, the refuse compactors of the invention may be provided with sockets at the ends of the refuse container, as indicated at 400 in FIG. 15, for slidably receiving the fork arms of the collection vehicle in much the same manner as do the sockets on conventional trash bins of the kind which are handled and emptied by such vehicles. When thus being emptied by a trash collection vehicle, the compactor cover lock will be released to permit the cover to swing open when the trash compactor is inverted in its elevated position over the refuse recepticle of the collection vehicle. While FIG. 15 illustrates a refuse compactor of the kind shown in FIGS. 1 through 10, fitted with a front cover panel 402, it is apparent that any of the described refuse compactors of the invention may be adapted to be emptied in the same fashion, or adapted for connection to side loaders or rear loaders.

I claim:

1. A refuse compactor comprising:

a refuse container including relatively rigid walls and a movable pressure plate normally disposed in mutual fluid sealing relation to form a refuse receiving space at one side of said plate;

means providing access to said space for placement of refuse in and removal of refuse from said space;

means supporting said pressure plate for movement relative to said walls in the direction of said space through a refuse compression stroke to compress refuse in said space and in the opposite direction through a return stroke;

and pressure plate operating means for selectively evacuating said space to effect movement of said pressure plate through its compression stroke by atmospheric pressure and producing a pressure differential across said pressure plate to effect movement of the plate through its return stroke.

2. A refuse compactor according to claim 1 wherein:

said pressure plate supporting means comprises a hinge, whereby said plate is swingable through its compression and return strokes.

3. A refuse compactor according to claim 2 wherein:

said container walls include a bottom wall, end walls, a side wall, and a top wall;

said pressure plate extends between said end walls in confronting relation to said side wall to form said refuse space between said side wall and pressure plate, and said pressure plate is hinged on said bottom wall to swing towards said side wall during its compression stroke and away from said side wall during its return stroke; and said top wall comprises a movable cover forming said access providing means; and said top cover is cylindrically curved about an axis which coincides approximately with the pivot axis of said plate and is disposed in fluid sealing relation to the adjacent pressure plate edge when the cover is closed.

4. A refuse compactor according to claim 3 wherein:

said container is adapted to be handled and emptied by a refuse collection vehicle having a container elevating mechanism including a pair of vertically swinging fork arms for straddling the container endwise and elevating the container to an inverted position;

said container cover is hinged to open in said inverted position to permit refuse to drop from said refuse space; and said container end walls mount sockets for removably receiving said fork arms.

5. A refuse compactor according to claim 1 wherein:

gravity acts on said pressure plate in the direction of its compression stroke during a terminal portion of the latter stroke; and said pressure plate operating means is operable to leave said plate at any position in said terminal stroke portion such that gravity retains the plate in compressing relation to refuse in said refuse space.

6. A refuse compactor according to claim 5 wherein:

said container walls include a bottom wall, end walls, a side wall, and a top wall;

said pressure plate extends between said end walls in confronting relation to said side wall to form said refuse space between said side wall and plate, and said plate is hinged on said bottom wall to swing toward said side wall during its compression stroke and away from said side wall during its return stroke;

said pressure plate inclines from the vertical towards said side wall during said terminal stroke portion;

said top wall comprises a movable cover which forms said access providing means; and said cover is cylindrically curved about an axis which coincides approximately with the pivot axis of said plate and is disposed in fluid sealing relation to the adjacent plate edge when the cover is closed.

7. A refuse compactor according to claim 1 wherein:

said pressure plate operating means comprises means for pressurizing said refuse space to effect movement of said pressure plate through its return stroke.

8. A refuse compactor according to claim 1 wherein:

said pressure plate operating means comprises a vacuum source and a pressure air source, and means for selectively communicating said sources to said refuse space.

9. A refuse compactor according to claim 8 wherein:

said operating means comprises a vacuum pump having an intake forming said vacuum source and a discharge forming said pressure air source.

10. A refuse compactor according to claim 9 wherein:

said pressure plate supporting means comprises a hinge, whereby said plate is swingable through its compression and return strokes.

11. A refuse compactor according to claim 10 wherein:

said container walls include a bottom wall, end walls, a side wall, and a top wall;

said pressure plate extends between said end walls in confronting relation to said side wall to form said refuse space between said side wall and plate, and said plate is hinged on said bottom wall to swing towards said side wall during its compression stroke and away from said side wall during its return stroke;

said top wall comprises a movable cover which forms said access providing means; and said cover is cylindrically curved about an axis which coincides approximately with the pivot axis of said plate and is disposed in fluid sealing relation to the adjacent plate edge when the cover is closed.

12. A refuse compactor according to claim 11 wherein:

said vacuum pump is mounted on said bottom wall; and said communicating means comprises a passage extending edgewise through said bottom wall and container side wall to said refuse space and valve means for selectively communicating said vacuum pump intake and discharge to said passage.

13. A refuse compactor according to claim 1 wherein:

said container walls and pressure plate form a second space at the opposite side of said plate; and said pressure plate operating means comprises means for selectively venting said second space to atmosphere during evacuation of said refuse space to effect movement of said plate through its refuse compression stroke and evacuating said second space while venting said refuse space to effect movement of said plate through its return stroke.

14. A refuse compactor according to claim 1 wherein:

said container walls and pressure plate form a second space at the opposite side of said plate;

said pressure plate operating means comprises a vacuum pump having an intake, and means for selectively communicating said pump intake to said refuse space and said second space to atmosphere to effect movement of said pressure plate through its compression stroke and communicating said intake to said second space and said refuse space to atmosphere to effect movement of said plate through its return stroke.

15. A refuse compactor according to claim 14 wherein:

said pressure plate supporting means comprises a hinge, whereby said plate is swingable through its refuse compression and return strokes.

16. A refuse compactor according to claim 15 wherein:

said container walls include a bottom wall, end walls, a side wall, and a top wall;

said pressure plate extends between said end walls in confronting relation to said side wall to form said refuse space between said side wall and plate, and said pressure plate is hinged on said bottom wall to swing towards said side wall during its compression stroke and away from said side wall during its return stroke;

said top wall comprises a movable cover which forms said access providing means; and said cover is cylindrically curved about an axis which coincides approximately with the pivot axis of said plate and is disposed in fluid sealing relation to the adjacent plate edge when the cover is closed.

17. A refuse compactor according to claim 16 wherein:

said communicating means comprises a first passage in said cover, opening to said refuse space, a second passage in said cover opening to said second space, and valve means on said cover for selectively communicating either passage to said pump intake and the other passage to atmosphere.

18. A refuse compactor according to claim 16 wherein:

said pump is mounted on said bottom container wall; and said communicating means comprises a passage in said pressure plate opening to one of said spaces, and valve means for selectively communicating either space to said pump intake and the other space to atmosphere.

19. A refuse compactor comprising:

a refuse container having a bottom wall, end walls, a side wall, and a cover hinged along its rear edge to the upper edge of the rear wall;

a pressure plate extending lengthwise of said container between said end walls and forming with said side wall a refuse compression space between said plate and side wall;

a hinge along the lower edge of said pressure plate supporting the latter for swinging movement towards said side wall through a refuse compression stroke and away from said side wall through a return stroke;

said cover being cylindrically curved about the pivot axis of said pressure plate;

means sealing said walls, cover, and pressure plate to one another when said cover is closed, whereby said refuse space is substantially air tight; and pressure plate operating means for selectively evacuating said space to effect movement of said pressure plate through its refuse compression stroke by atmospheric pressure and producing a pressure differential across said pressure plate to effect movement of the plate through its return stroke.

20. A refuse compactor according to claim 19 wherein:

said pressure plate operating means includes means for pressurizing said refuse space to produce said pressure differential across said pressure plate.

21. A refuse compactor according to claim 20 wherein:

said container includes a second side wall and a second space between said pressure plate and said second side wall which is substantially air tight when said cover is closed; and said pressure plate operating means comprises means for selectively evacuating said spaces to effect movement of said pressure plate through its refuse compression and return strokes by atmospheric pressure.

22. A refuse compactor according to claim 21 wherein:

said refuse space is located between said pressure plate and the front side wall of said container.

23. A refuse compactor according to claim 21 wherein:

each of said spaces forms a refuse compression space and each of the strokes of said pressure plate comprises a refuse compression stroke.

24. A refuse compactor according to claim 19 wherein:

said pressure plate operating means comprises a vacuum pump having an intake and a discharge, and means for selectively communicating said refuse space to said pump intake for creating said vacuum in said space and to said pump discharge for pressurizing said space to produce a pressure differential across said plate.

25. A refuse compactor according to claim 19 wherein:

said container has a second side wall and a second space between said pressure plate and a second side wall which is substantially air tight once said cover is closed; and said pressure plate operating means comprises a vacuum pump having an intake, and means for selectively communicating said spaces to said intake for evacuating said first mentioned chamber and producing said pressure differential across said plate.

26. A refuse compactor according to claim 25 wherein:

said pressure plate operating means comprises an operating unit including said vacuum pump and valve and mounted on said cover; and said cover contains passages through which said valve communicates said pump intake to said spaces.

27. A refuse compactor according to claim 25 wherein:

said pressure plate operating means comprises an operating unit including said vacuum pump and valve mounted on said bottom container wall; and said valve communicates said pump intake directly to one of said spaces and to the other space through a passage in said pressure plate.

28. A refuse compactor comprising:

a refuse container including relatively rigid walls and a movable pressure plate forming a refuse receiving space at one side of said plate, means providing access to said space for placement of refuse in and removal of refuse from said space, and means supporting said pressure plate for movement relative to said walls in the direction of said space through a refuse compression stroke to compress refuse in said space and in the opposite direction through a return stroke;

sealing means for mutually sealing said walls and pressure plate to one another, whereby said refuse space is substantially air tight, said sealing means including a sealing element about the edge of said pressure plate disposed in sliding contact with walls of said container;

pressure plate operating means for selectively evacuating said refuse space to effect movement of said pressure plate through its refuse compression stroke by atmospheric pressure and producing a pressure differential across said pressure plate to effect movement of the plate through its return stroke; and wiper means about said pressure plate edge located in advance of said pressure plate sealing element relative to the direction of movement of said pressure plate through its compression stroke and disposed in sliding contact with said container walls for wiping said walls free of debris which would damage said sealing element.

29. A refuse compactor according to claim 28 wherein:

said pressure plate is hinged along one edge portion to swing through its refuse compression and return strokes; and said pressure plate sealing element and wiper extend along the remaining edge portion of said pressure plate.

30. A refuse compactor according to claim 29 wherein:

said compactor includes an air tight space at each side of said pressure plate;

said pressure plate operating means comprises means for selectively evacuating said spaces to effect movement of said pressure plate through said compression and return strokes; and said pressure plate includes a second wiper along said remaining edge portion of said pressure plate and said sealing element is located between said wipers.

31. A refuse compactor according to claim 29 wherein:

said container walls include a bottom wall, end walls, a side wall, and a cover;

said pressure plate extends endwise of said container between said end walls;

said refuse space is formed between said pressure plate and said side walls;

said pressure plate supporting means comprises a hinge along the lower edge of said pressure plate pivotally mounting said plate on said bottom wall;

said cover is cylindrically curved about the pivot axis of said pressure plate; and said pressure plate sealing element and wiper engage said cover and end walls.

32. A refuse compactor adapted to be emptied by a refuse collection vehicle having hinged vertically swingable fork arms for elevating and inverting the compactor, comprising:

a refuse container including a bottom wall, end walls, a side wall, a hinged cover, a pressure plate extending endwise of said container between said end walls and forming with said side wall a refuse compression space between said plate and side wall, and a hinge along the lower edge of said pressure plate supporting the plate on said bottom wall for swinging towards said side wall through a refuse compression stroke and away from said side wall through a return stroke;

means mutually sealing said walls, cover, and pressure plate to one another, whereby said refuse space is substantially air tight when said cover is closed;

pressure plate operating means for selectively evacuating said space to effect movement of said pressure plate through its compression stroke by atmospheric pressure and producing a pressure differential across said pressure plate to effect movement of the plate through its return stroke; and sockets on the ends of said container for slidably receiving collection vehicle fork arms, whereby said compactor may be elevated to inverted position by the fork arms to empty refuse from said refuse space.

33. A refuse compactor according to claim 32 wherein:

said cover is cylindrically curved about the pivot axis of said pressure plate and is hinged along its rear edge to the rear of said container to as to swing open in the elevated position of said container.

34. A refuse compactor according to claim 33 wherein:

said container includes a second side wall forming with said pressure plate a second refuse space at the opposite side of said plate; and said container is invertable by said refuse collection vehicle to empty refuse from both of said spaces.

* * * * *